US009916788B2

(12) United States Patent
Tokunaga et al.

(10) Patent No.: US 9,916,788 B2
(45) Date of Patent: Mar. 13, 2018

(54) ORGANIC ELECTROLUMINESCENT DISPLAY DEVICE

(71) Applicant: JOLED INC., Tokyo (JP)

(72) Inventors: Tsutomu Tokunaga, Tokyo (JP); Noriyuki Iwakura, Hokkaido (JP); Takashi Iwami, Hyogo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 15/123,080

(22) PCT Filed: Dec. 19, 2014

(86) PCT No.: PCT/JP2014/006352
§ 371 (c)(1),
(2) Date: Sep. 1, 2016

(87) PCT Pub. No.: WO2015/132834
PCT Pub. Date: Sep. 11, 2015

(65) Prior Publication Data

US 2017/0069268 A1 Mar. 9, 2017

(30) Foreign Application Priority Data

Mar. 6, 2014 (JP) ..... 2014-044326

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3233; G09G 3/3266; G09G 3/3275; G09G 3/3291;
(Continued)

(56) References Cited

U.S. PATENT DOCUMENTS 6,897,758 B1 5/2005 Baumgaertl et al.
7,116,299 B2 10/2006 Nah et al.
(Continued)

FOREIGN PATENT DOCUMENTS

JP 2002-196314 7/2002
JP 2007-140318 6/2007
(Continued)

OTHER PUBLICATIONS

International Search Report, dated Mar. 31, 2015, for International Application No. PCT/JP2014/006352.

*Primary Examiner* — Richard Hong
(74) *Attorney, Agent, or Firm* — Greenblum & Bernstein, P.L.C.

(57) ABSTRACT

An organic electroluminescent display device includes: a display unit in which pixels are arranged in rows and columns, the pixels each including an organic electroluminescent element, a drive transistor, and a capacitor; a power supply unit which generates a supply voltage; a gate drive unit which applies a reference supply voltage to the capacitor; and a control unit which carries the supply voltage from the power supply unit to the gate drive unit, wherein the gate drive unit includes a buffer amplifier circuit which suppresses a variable component of the supply voltage carried via the control unit to stabilize the reference supply voltage, and supplies the stabilized reference supply voltage to the pixel.

7 Claims, 10 Drawing Sheets

(51) Int. Cl.

| | |
|---|---|
| ***G09G 3/3233*** | (2016.01) |
| ***G09G 3/3266*** | (2016.01) |
| ***G09G 3/3275*** | (2016.01) |

(52) U.S. Cl.

CPC ... *G09G 3/3275* (2013.01); *G09G 2300/0861* (2013.01); *G09G 2310/0248* (2013.01); *G09G 2310/0251* (2013.01); *G09G 2310/0291* (2013.01); *G09G 2310/08* (2013.01); *G09G 2330/021* (2013.01); *G09G 2330/025* (2013.01); *G09G 2330/028* (2013.01)

(58) Field of Classification Search

CPC ..... G09G 3/3688; G09G 2300/0861; G09G 2310/0251; G09G 2310/0248; G09G 2310/0291; G09G 2310/08; G09G 2330/021; G09G 2330/025; G09G 2330/028; H05K 7/20963

See application file for complete search history.

(56) References Cited

U.S. PATENT DOCUMENTS

| | | | | |
|---|---|---|---|---|
| 8,068,082 | B2 | 11/2011 | Cho et al. | |
| 2002/0060661 | A1 | 5/2002 | Nah et al. | |
| 2005/0219177 | A1 | 10/2005 | Nah et al. | |
| 2010/0007596 | A1 | 1/2010 | Cho et al. | |
| 2011/0057913 | A1 | 3/2011 | Chung | |
| 2011/0063272 | A1* | 3/2011 | Kim | H05K 7/20963 345/211 |
| 2015/0014712 | A1* | 1/2015 | Kim | G09G 3/3688 257/88 |
| 2015/0213757 | A1* | 7/2015 | Takahama | G09G 3/3291 345/691 |

FOREIGN PATENT DOCUMENTS

| | | |
|---|---|---|
| JP | 2009-145531 | 7/2009 |
| JP | 2010-020280 | 1/2010 |
| JP | 2011-059683 | 3/2011 |

* cited by examiner

Initialize

Detect Vth

Write

Emit light

With buffer amplifier circuit on driver board

Without buffer amplifier circuit on driver board

ORGANIC ELECTROLUMINESCENT DISPLAY DEVICE

TECHNICAL FIELD

The present disclosure relates to an organic electroluminescent (EL) display device, and, in particular, an active matrix display device which utilizes organic EL elements.

BACKGROUND ART

In general, luminance of an organic EL element disposed on a display panel increases in proportion to drive current supplied to the element. Thus, particularly in active matrix organic EL displays, with upsizing of the display panel, local fluctuations in voltage on a supply line for supplying current to an organic EL light emitting element and display unevenness are prominent due to variations in characteristics of the organic EL light emitting elements and drive transistors. This ends up decreasing display quality.

Patent Literature 1 discloses a display device which includes organic EL elements, in which a scanning line for transmitting a pixel select signal to pixels and a power supply line are connected via a Pch transistor included in an output circuit which outputs the pixel select signal to the scanning line. Patent Literature 1 discloses a configuration in which capacitance sufficiently greater than parasitic capacitance to the power supply line is added in order to avoid a decrease of scanning line potential caused by connecting the scanning line and the power supply line via the Pch transistor. Patent Literature 1 asserts that this ensures execution of mobility correction dependent on a transition time between High voltage and Low voltage, the High voltage and the Low voltage being pixel select signals on the scanning line.

CITATION LIST

Patent Literature

[Patent Literature 1] Japanese Unexamined Patent Application Publication No. 2009-145531

SUMMARY OF INVENTION

Technical Problem

However, the configuration of the display device disclosed in Patent Literature 1 cannot suppress fluctuations in supply voltages, such as an initialization supply voltage and a reference supply voltage, which are directly applied to a drive transistor included in each pixel and a capacitor connected to the gate and source of the drive transistor. The initialization supply voltage and the reference supply voltage as used herein respectively refer to, for example, a fixed voltage defining initial potential of both electrodes of the capacitor when a threshold voltage of the drive transistor is detected; and a supply voltage on which the accuracy of threshold voltage correction depends. Thus, as the supply voltage fluctuates, luminance variations result in a form of horizontal stripes.

Moreover, in a thin, organic EL display panel having narrow borders, a power supply board disposed on the display panel back surface is connected to the pixels disposed on the display panel front surface via a timing control circuit, source drivers, gate drivers, etc. Due to this, the greater the screen is upsized, the greater the line distance increases. Accordingly, line resistance increases, increasing fluctuations in supply voltage applied to the pixel.

Thus, an object of the present disclosure is to provide an organic electroluminescent display device which supplies a stabilized supply voltage to each pixel.

Solution to Problem

In order to solve the above problem, an organic EL display device according to one aspect of the present disclosure includes: a display unit in which pixels are arranged in rows and columns, the pixels each including an organic electroluminescent element; a drive transistor which drives light emission of the organic electroluminescent element; and a capacitor having a first electrode to which a gate potential of the drive transistor is applied and a second electrode to which a potential of one of a drain and a source of the drive transistor is applied; a power supply unit configured to generate a supply voltage; a signal drive unit disposed on an electrical path between the power supply unit and the display unit, the signal drive unit configured to apply a fixed voltage corresponding to the supply voltage to at least one of the first electrode and the second electrode and output a data signal corresponding to a video signal and a select signal which selects a pixel to be supplied with the data signal among the pixels; and a timing control unit disposed on an electrical path between the power supply unit and the signal drive unit, the timing control unit configured to carry to the signal drive unit the supply voltage output from the power supply unit, and indicate to the signal drive unit a time at which the signal drive unit is to output the data signal and the select signal, wherein the signal drive unit includes a buffer amplifier circuit which suppresses a variable component of the supply voltage carried from the power supply unit to stabilize the fixed voltage corresponding to the supply voltage, and supplies the stabilized, fixed voltage to the at least one of the first electrode and the second electrode.

Advantageous Effects of Invention

According to the organic EL display device according to the present disclosure, since buffer amplifier circuits are disposed in the signal drive units, a supply voltage to be applied to a capacitor included in each pixel is stabilized. This allows display unevenness to be suppressed.

DESCRIPTION OF EMBODIMENTS

Figure 1:
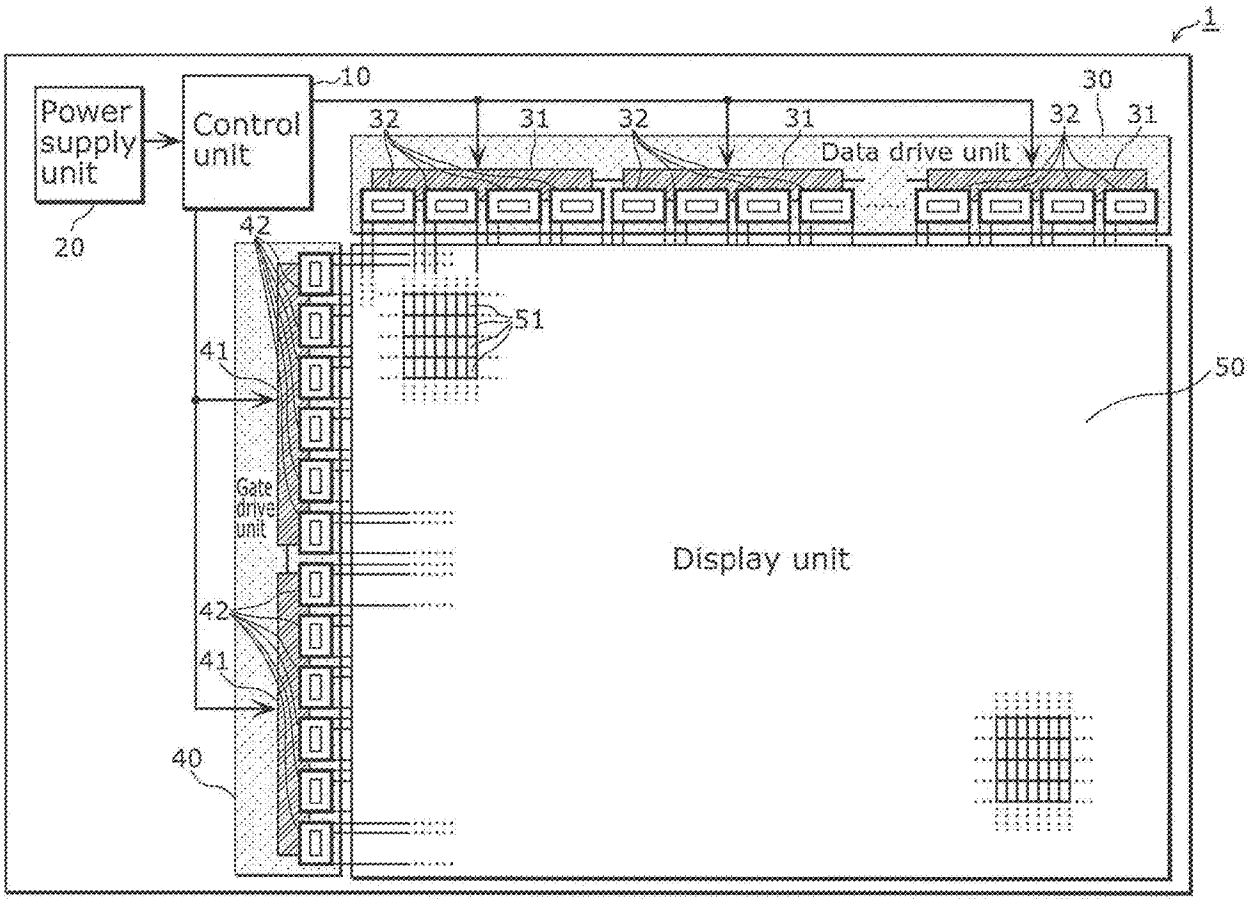
FIG. 1 is a block diagram illustrating basic configuration of an organic EL display device according to an embodiment.

An organic EL display device according to the present embodiment includes: a display unit in which pixels are arranged in rows and columns, the pixels each including an organic electroluminescent element; a drive transistor which drives light emission of the organic electroluminescent element; and a capacitor having a first electrode to which a gate potential of the drive transistor is applied and a second electrode to which a potential of one of a drain and a source of the drive transistor is applied; a power supply unit configured to generate a supply voltage; a signal drive unit disposed on an electrical path between the power supply unit and the display unit, the signal drive unit configured to apply a fixed voltage corresponding to the supply voltage to at least one of the first electrode and the second electrode and output a data signal corresponding to a video signal and a select signal which selects a pixel to be supplied with the data signal among the pixels; and a timing control unit disposed on an electrical path between the power supply unit and the signal drive unit, the timing control unit configured to carry to the signal drive unit the supply voltage output from the power supply unit, and indicate to the signal drive unit a time at which the signal drive unit is to output the data signal and the select signal, wherein the signal drive unit includes a buffer amplifier circuit which suppresses a variable component of the supply voltage carried from the power supply unit to stabilize the fixed voltage corresponding to the supply voltage, and supplies the stabilized, fixed voltage to the at least one of the first electrode and the second electrode.

According to the above configuration, the buffer amplifier circuits are disposed on the signal drive units that are disposed at positions closer to the display unit than the power supply unit and the timing control unit are. Thus, stabilized, fixed voltage is supplied to the pixels, without being affected by the resistances of lines electrically connecting the power supply unit, the timing control unit, and the signal drive unit. This thus allows display unevenness of a display panel to be suppressed.

Moreover, for example, the fixed voltage may be at least one of a reference supply voltage and an initialization supply voltage, the reference supply voltage being applied to the first electrode to cause the capacitor to hold a threshold voltage of the drive transistor, the initialization supply voltage being applied to the second electrode.

This allows an accurate threshold voltage to be held at the capacitor during the detection period of threshold voltage of the drive transistor. This thus allows display unevenness due to variations in characteristics of drive transistors to be resolved precisely.

Moreover, for example, the signal drive unit may include: a gate drive unit configured to output the select signal; and a data drive unit configured to output the data signal, wherein the gate drive unit includes a plurality of gate driver integrated circuits and a gate driver board connecting the plurality of gate driver integrated circuits and the timing control unit, the data drive unit includes a plurality of source driver integrated circuits and a source driver board connecting the plurality of source driver integrated circuits and the timing control unit, the display unit is disposed on a front surface of a display panel, the power supply unit, the timing control unit, a line electrically connecting the timing control unit and the signal drive unit, and the buffer amplifier circuit are disposed on a back surface of the display panel, a first buffer amplifier circuit, which outputs to the plurality of gate driver integrated circuits the reference supply voltage stabilized by suppressing the variable component of the supply voltage, is mounted on the gate driver board, and a second buffer amplifier circuit, which outputs to the plurality of source driver integrated circuits the initialization supply voltage stabilized by suppressing the variable component of the supply voltage, is mounted on the source driver board.

This allows the buffer amplifier circuits to be disposed on the driver boards that are disposed at positions closer to the display unit than the power supply unit and the timing control unit are. Thus, the pixel is supplied with stabilized reference supply voltage and stabilized initialization supply voltage that are unaffected by the resistances of the lines electrically connecting the power supply unit, the timing control unit, and the driver boards that are disposed on the display panel back surface, thereby allowing display unevenness on the display panel to be suppressed.

Moreover, for example, the gate drive unit may include: a first gate driver board disposed on a left edge portion of the display panel and connecting the timing control unit and gate driver integrated circuits among the plurality of gate driver integrated circuits and; and a second gate driver board disposed on a right edge portion of the display panel and connecting the timing control unit and gate driver integrated circuits among the plurality of gate driver integrated circuits.

This allows reduction of the fluctuations in the reference supply voltage at the pixel due to a resistance component of a reference supply line that is disposed on the display unit and carries the reference supply voltage.

Moreover, for example, the data drive unit may include: a first source driver board disposed on a top edge portion of the display panel and connecting the timing control unit and source driver integrated circuits among the plurality of source driver integrated circuits; and a second source driver board disposed on a bottom edge portion of the display panel and connecting the timing control unit and source driver integrated circuits among the plurality of source driver integrated circuits.

This allows reduction of the fluctuations in the initialization supply voltage at the pixel due to a resistance component of the initialization supply line that is disposed on the display unit and carries the initialization supply voltage.

Moreover, for example, while causing the gate drive unit to select a pixel row-by-row, the timing control unit may cause the capacitor to hold the threshold voltage of the drive transistor row-by-row by causing the gate drive unit to apply the reference supply voltage to the first electrode of the capacitor and causing the data drive unit to apply the initialization supply voltage to the second electrode of the capacitor.

This corrects the threshold voltage. Thus, precise light emission operation that is unaffected by variations in characteristics of drive transistors is achieved.

Moreover, for example, the first buffer amplifier circuit may include a first amplifying element having a positive power supply terminal to which the supply voltage carried via the timing control unit is input, a positive input terminal to which a predetermined positive voltage generated by the timing control unit is input, and a negative input terminal and an output terminal which are shorted, and the second buffer amplifier circuit includes a second amplifying element having a negative power supply terminal to which the supply voltage is carried via the timing control unit is input, a positive input terminal to which a predetermined negative voltage generated by the timing control unit is input, and a negative input terminal and an output terminal which are shorted.

This allows the buffer amplifier circuit having a low profile to be disposed on the driver board. Thus, even if the supply voltage fluctuates before reaching the input terminal of the driver board, a fixed voltage having a reduced fluctuation is supplied to the pixel, without increasing the thickness of the display panel.

The embodiments described below are each general and specific illustration. Values, shapes, materials, components, and arrangement and connection between the components, steps, and the order of the steps shown in the following embodiments are merely illustrative and not intended to limit the present disclosure. Among the components in the embodiments below, components not recited in any one of the independent claims indicating the most generic part of the inventive concept of the present disclosure are described as arbitrary components.

For the purposes of facilitating an understanding of the figures and for ease of illustration, some components are omitted or scaled up or down in the figures. Components referred to using the same reference number or sign include/have the same or similar embodiment, material, operation, or associated items or actions.

[Embodiment]

[Basic Configuration of Organic El Display Device]

Configuration of an organic EL display device according to the present embodiment is described with reference to FIG. 1.

FIG. 1 is a block diagram illustrating basic configuration of the organic EL display device according to the embodiment. An organic EL display device 1 according to the present embodiment includes a control unit 10, a power supply unit 20, a data drive unit 30, a gate drive unit 40, and a display unit 50. The display unit 50 is a display area in which pixels 51 are arranged in rows and columns. It should be noted that each pixel 51 and the data drive unit 30 are connected via a data line and an initialization supply line which are disposed for each column of pixels. Meanwhile, each pixel 51 and the gate drive unit 40 are connected via a scanning line and a reference supply line which are disposed for each row of pixels.

The power supply unit 20 generates supply voltage. More specifically, the power supply unit 20 generates a supply voltage corresponding to at least one of a reference supply voltage (first supply voltage) and an initialization supply voltage (second supply voltage). The reference supply voltage is applied to a first electrode of a capacitor which is a circuit component of the pixel 51. The initialization supply voltage is applied to a second electrode of the capacitor.

The control unit 10 is disposed on an electrical path between the power supply unit 20 and the data drive unit 30 and an electrical path between the power supply unit 20 and the gate drive unit 40. The control unit 10 carries the supply voltage from the power supply unit 20 to the data drive unit 30 and the gate drive unit 40. The control unit 10 also serves as a timing control unit which indicates to the data drive unit 30 a time to output a data signal corresponding to a video signal, and indicates to the gate drive unit 40 a time to output a select signal which selects a pixel to be supplied with the data signal.

The data drive unit 30 is disposed on electrical paths between the power supply unit 20 and the display unit 50. The data drive unit 30 applies the initialization supply voltage via an initialization supply line to the second electrode of a capacitor included in the pixel 51. The data drive unit 30 also outputs to the pixel 51 a data voltage corresponding to a grayscale signal via the data line, based on the indication by the control unit 10. Specifically, the data drive unit 30 is configured of source driver boards 31 and COFs (Chip on Film, Chip on Flexible) 32. At least two COFs 32 are disposed on each source driver board 31. The data drive unit 30 outputs the data voltage to each pixel, based on the video signal and a horizontal synchronization signal. The COF 32 corresponds to a source driver integrated circuit (IC). The source driver board 31 is a printed circuit board connecting the COFs 32 and the control unit 10.

The gate drive unit 40 is disposed on electrical paths between the power supply unit 20 and the display unit 50. The gate drive unit 40 applies the reference supply voltage to the first electrode of the capacitor, which is a circuit component of the pixel 51, via the reference supply line, and outputs the select signal to the pixel 51 via the scanning line based on the indication by the control unit 10. Specifically, the gate drive unit 40 is configured of gate driver boards 41 and COFs 42. At least two COFs 42 are disposed on each gate driver board 41. The gate drive unit 40 outputs the select signal to the pixel on a per pixel-row basis, based on a vertical synchronization signal and the horizontal synchronization signal. The COF 42 corresponds to a gate driver IC. The gate driver board 41 is a printed circuit board connecting the COFs 42 and the control unit 10.

[Configuration and Operation of Display Unit]

In the following, configuration and operation of the display unit 50 are described.

Figure 2A:
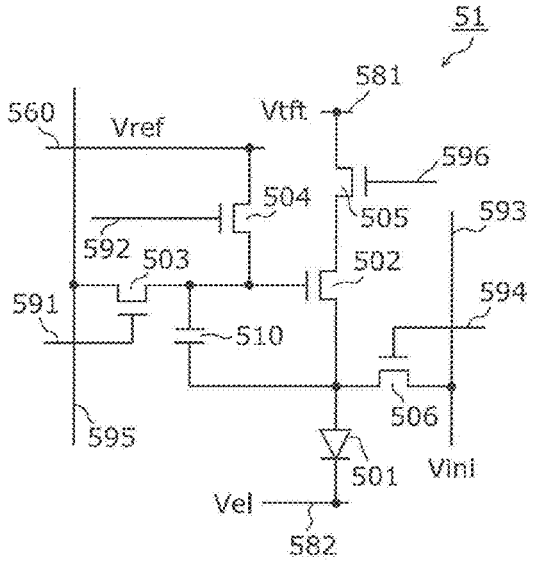
FIG. 2A is a diagram illustrating an example of pixel circuit configuration of the organic EL display device according to the embodiment.

FIG. 2A is a diagram illustrating an example of pixel circuit configuration of the organic EL display device according to the embodiment. FIG. 2A illustrates a circuit of one of the pixels 51 arranged in rows and columns on the display panel. The pixel 51 includes an organic EL element 501, a drive transistor 502, switches 503, 504, 505, and 506, and a capacitor 510. A reference supply line 560, an EL anode supply line 581 (Vtft), an EL cathode supply line 582 (Vel), an initialization supply line 593 (Vini), a scanning line 591, a reference voltage control line 592, an initialization control line 594, an emission control line 596, and a data line 595 are routed to the pixel 51.

The organic EL element 501 is, by way of example, a light-emitting element. Drive current from the drive transistor 502 causes the organic EL element 501 to emit light. The organic EL element 501 has the cathode connected to the EL cathode supply line 582 and the anode connected to the source of the drive transistor 502.

The drive transistor 502 is a voltage-driven drive element which controls supply of current to the organic EL element 501. The drive transistor 502 has the gate connected to a first electrode of the capacitor 510, and the source connected to a second electrode of the capacitor 510 and the anode of the organic EL element 501. The drive transistor 502 causes the organic EL element 501 to emit light by passing the drive current, which is current depending on a data signal voltage, through the organic EL element 501 when the switch 504 is off and the switch 505 is on. Here, a voltage Vtft supplied to the EL anode supply line 581 is 19 V, for example. In contrast, the drive transistor 502 causes the organic EL element 501 to emit no light by not passing the drive current through the organic EL element 501 when the switch 504 is off and the switch 505 is off. Threshold voltage of the drive transistor 502 is detected at the capacitor 510 while the switch 504 is on, the switch 503 is off, the switch 506 is off, and the switch 505 is on.

The capacitor 510 holds a voltage which determines an amount of current to be passed through the drive transistor 502. The first electrode of the capacitor 510 is connected to the gate of the drive transistor 502, and further connected to the reference supply line 560 (Vref) via the switch 504. The reference supply line 560 is also connected to the COF 42. This sets the first electrode of the capacitor 510 to the reference supply voltage. The capacitor 510 maintains the reference supply voltage Vref applied thereto, for example, even after the switch 504 turns off, and the capacitor 510 continues to supply the reference supply voltage Vref to the gate of the drive transistor 502. The data voltage is applied to the capacitor 510 when the switch 503 turns on, and the capacitor 510 holds the data voltage after the switch 504 turns off. Then, the capacitor 510 causes the drive transistor 502 to supply the drive current to the organic EL element 501 when the switch 505 turns back on.

The switch 503 is a switching element which switches conduction and non-conduction between the first electrode of the capacitor 510 and the data line 595 for supplying the data voltage to the capacitor 510. The switch 503 is an NMOS transistor, for example.

The switch 504 is a switching element which switches conduction and non-conduction between the reference supply line 560, which supplies the reference supply voltage Vref to the capacitor 510, and the first electrode of the capacitor 510. The switch 504 is an NMOS transistor, for example.

The switch 506 is a switching transistor which switches conduction and non-conduction between the second electrode of the capacitor 510 and the initialization supply line 593. The switch 506 has capabilities of providing the initialization supply voltage Vini to the second electrode of the capacitor 510. It should be noted that the initialization supply line 593 is connected to the COF 32.

The switch 505 is a switching transistor which switches conduction and non-conduction between the EL anode supply line 581 and the drain of the drive transistor 502. The switch 505 is an NMOS transistor, for example. The switch 505 has capabilities of providing the potential Vtft to the drain of the drive transistor 502 and causing a threshold voltage Vth of the drive transistor 502 to be detected.

While the switches 503 to 506 are described as n-type TFTs, it should be noted that the switches 503 to 506 may be p-type TFTs, or may be a mixture of n-type TFTs and p-type TFTs.

The reference supply line 560 electrically connects the COF 42 and the pixel 51, and carries to the pixel 51 the reference supply voltage Vref (first supply voltage) which defines a voltage value of the first electrode of the capacitor 510. The initialization supply line 593 electrically connects the COF 32 and the pixel 51, and carries to the pixel 51 the initialization supply voltage Vini (second supply voltage) which initializes the source of the drive transistor 502 and the second electrode of the capacitor 510.

The EL anode supply line 581 is a drive supply line for supplying the drain of the drive transistor 502 with driving potential. The EL cathode supply line 582 is a low-voltage-side supply line connected to the cathode of the organic EL element 501.

From the standpoint of the detection of threshold voltage of the drive transistor 502, a potential difference between the reference supply voltage Vref and the initialization supply voltage Vini is set to a voltage greater than a maximum threshold voltage of the drive transistor 502.

It should be noted that the organic EL display device 1 may include, for example, a central processing unit (CPU), a storage medium storing a control program, such as a read only memory (ROM), a work memory such as a random access memory (RAM), and a communications circuit.

Next, a method of driving the organic EL display device according to the present embodiment is described with reference to FIG. 2B and FIGS. 3A, 3B, 3C, and 3D.

Figure 2B:
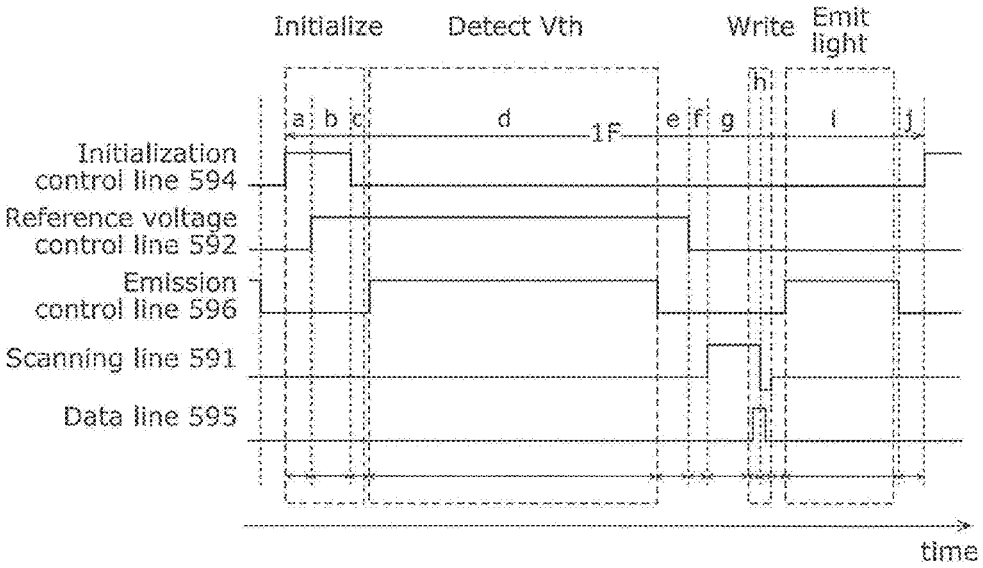
FIG. 2B illustrates an example of an operational timing diagram of the pixel circuit included in the organic EL display device according to the embodiment.

FIG. 2B illustrates an example of an operational timing diagram of the pixel circuit included in the organic EL display device according to the embodiment. It should be noted that the organic EL display device 1 according to the present embodiment is driven by a row-by-row scanning sequence. More specifically, in the organic EL display device 1, as illustrated in FIG. 2B, initialization, Vth (threshold voltage) detection, write operation, and light emission are carried out row-by-row. In the following, periods a, b, c, d, e, f, g, h, i, and j illustrated in FIG. 2B are to be described in listed order. In FIG. 2B, time is indicated on the horizontal axis. In the figure, waveform diagrams of voltages generated on the initialization control line 594, the reference voltage control line 592, the emission control line 596, the scanning line 591, and the data line 595 connected to a row of pixels 51, among the pixels included in the display panel, are indicated in the vertical axis direction.

The drive method is implemented by implementing the period a through the period j on the pixel 51 having the configuration described above.

[Period a]

In the period a, only the switch 506 is placed in the conductive state and thereby the source potential of the drive transistor 502 is stabilized (the source potential of the drive transistor 502 is set to the initialization supply voltage Vini).

[Period b]

In the period b, a voltage is applied to the first electrode of the capacitor 510 and the gate of the drive transistor 502, the voltage being used to pass drain current to the drive transistor 502 to detect a threshold voltage of the drive transistor 502 in the subsequent period d.

Figure 3A:
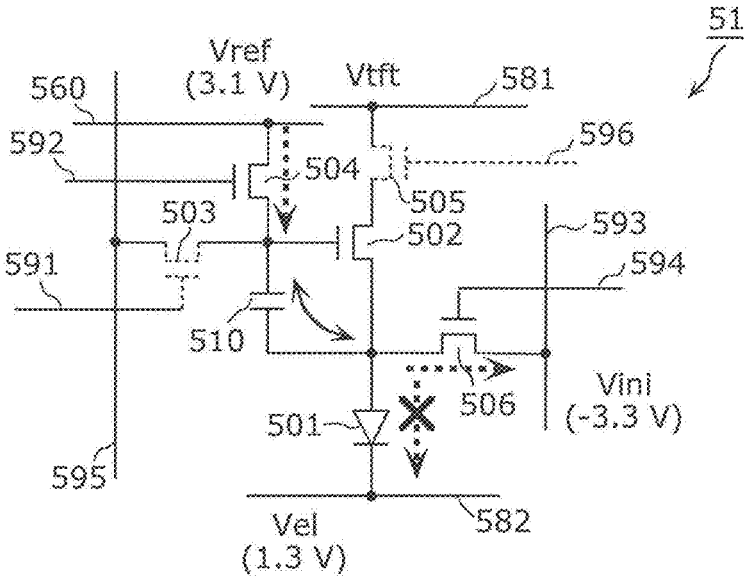
FIG. 3A is a diagram depicting a state of the pixel circuit during an initialization period.

FIG. 3A is a diagram depicting a state of the pixel circuit in an initialization period. Specifically, the voltage level of the reference voltage control line 592 is changed from LOW to HIGH and the switch 504 is placed in the conductive state. This applies the reference supply voltage Vref carried by the reference supply line 560 to the capacitor 510. Here, the reference supply voltage Vref is set to, for example, 3.1 V by the power supply unit 20 and the gate drive unit 40. Also, the initialization supply voltage Vini is set to, for example, −3.3 V by the power supply unit 20 and the data drive unit 30. Further, an EL cathode voltage Vel is set to, for example, 1.3 V. Due to the above voltage settings, a charging current flows from the reference supply line 560 toward the initialization supply line 593 into the capacitor 510 in the period b. This sets a gate-source voltage of the drive transistor 502 to a voltage that ensures initial drain current used to detect a threshold voltage of the drive transistor 502.

[Period c]

The period c is for eliminating a period during which the switches 505 and 506 are simultaneously placed in the conductive state. The switch 505 is placed in the conductive state in the subsequent period d. If the switch 506 is also in the conductive state in this time, shoot-through current undesirably flows between the EL anode supply line 581 and the initialization supply line 593 via the switch 505, the drive transistor 502, and the switch 506. To address this, the period c is provided to place the switch 506 in the non-conductive state when the switch 505 is in the conductive state, thereby preventing the shoot-through current from flowing in the beginning of a Vth detection period.

The period a through the period c constitute the initialization period. In the initialization period, the voltage used to pass the drain current to the drive transistor 502 in the detection period of Vth of the drive transistor 502 is charged to the capacitor 510.

[Period d]

In the period d, a threshold voltage of the drive transistor 502 is detected at the capacitor 510.

Figure 3B:
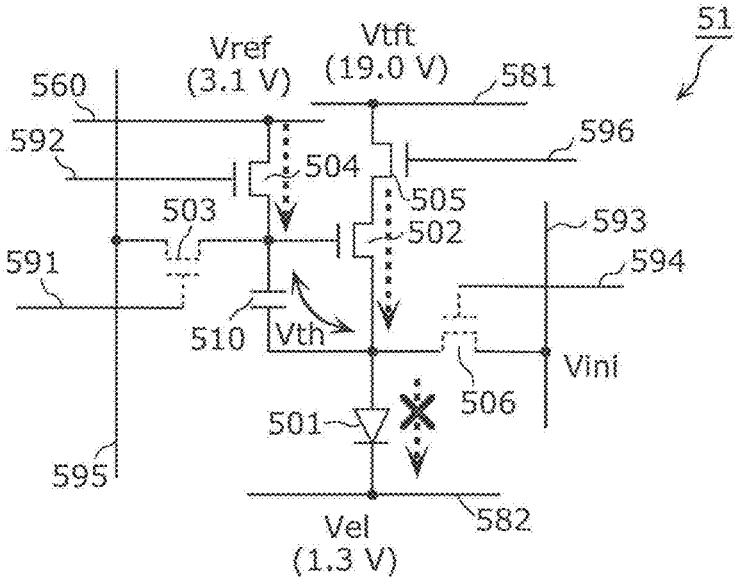
FIG. 3B is a diagram depicting a state of the pixel circuit during a Vth detection period.

FIG. 3B is a diagram depicting a state of the pixel circuit in the Vth detection period. Specifically, the voltage level of the scanning line 591 and the voltage level of the initialization control line 594 are maintained LOW, the voltage level of the reference voltage control line 592 is maintained HIGH, and the voltage level of the emission control line 596 is changed from LOW to HIGH. To be more specific, the switches 503 and 506 are off and the switches 504 and 505 are on.

At this time, due to the voltage setting (Vel=1.3 V) configured in the initialization period, the drain current, rather than current, flows through the organic EL element 501. This changes the source potential of the drive transistor 502. Stated differently, the source potential of the drive transistor 502 continues to change until the drain current supplied by the voltage Vtft of the EL anode supply line 581 reaches zero. In this manner, the detection of threshold voltage of the drive transistor 502 begins.

Then, at the end of the period d, a potential difference between the first electrode and the second electrode of the capacitor 510 (gate-source voltage of the drive transistor 502) is a potential difference corresponding to the threshold voltage Vth of the drive transistor 502.

[Period e]

In the period e, the detection of threshold voltage ends. Specifically, the voltage level of the emission control line 596 is changed from HIGH to LOW. To be more specific, the switch 505 is changed to off, while keeping the switches 503 and 506 off and the switch 504 on. This stops supply of the drain current, completing the detection of threshold voltage.

[Period f]

The period f is for preventing, by turning the switch 504 off, the data voltage supplied from the data line 595 and the reference supply voltage Vref supplied from the reference supply line 560 from being applied to the first electrode of the capacitor 510 simultaneously in the subsequent write period. Specifically, the voltage level of the reference voltage control line 592 is changed from HIGH to LOW, while keeping the voltage level of the initialization control line 594, the voltage level of the emission control line 596, and the voltage level of the scanning line 591 LOW. To be more specific, the switches 503 to 506 are all off.

[Period g]

In the period g, preparation for the write operation is done by turning the switch 503 on. Specifically, the voltage level of the scanning line 591 is changed from LOW to HIGH.

[Period h]

The period h is a write period in which a data voltage according to a grayscale of display is loaded from the data line 595 into the pixel 51 and written to the capacitor 510.

Figure 3C:
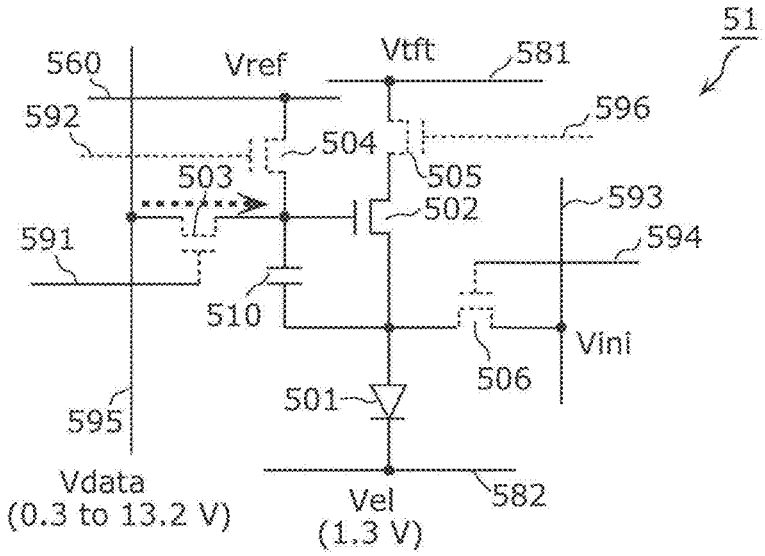
FIG. 3C is a diagram depicting a state of the pixel circuit during a write period.

FIG. 3C is a diagram depicting a state of the pixel circuit in the write period. Specifically, a data voltage Vdata (0.3 V to 13.2 V) is applied to the first electrode of the capacitor 510 via the data line 595 and the switch 503. This stores (holds) into the capacitor 510 a voltage difference between the data voltage and the reference supply voltage Vref, in addition to the threshold voltage Vth of the drive transistor 502 held at the capacitor 510 in the Vth detection period. The voltage difference is according to a ratio between the capacitance of the capacitor 510 and the parasitic capacitance of the organic EL element 501. Here, since the switch 505 is in the non-conductive state, the drive transistor 502 does not allow drain current to flow through the organic EL element 501.

Growing number of pixels along with an increased screen size gives less time to write a video signal to each pixel (horizontal scanning period). On the other hand, the time constant of the scanning line 591 increases with screen upsizing, and thus it is difficult to write the data voltage to the pixel 51 while reducing the horizontal scanning period. For this reason, the period g is provided in which a correct data voltage is written to the pixel 51 via the data line 595 even if the waveform of the scanning line 591 is rounded. In other words, the waveform of the voltage carried by the scanning line 591 is completely raised prior to application of the data voltage to the data line 595, so that the switch 503 is fully on. Moreover, at the end of the period h, the waveform of the voltage carried by the scanning line 591 is quickly fallen completely by setting the potential of the scanning line 591 lower than normal LOW level.

This allows the data voltage to be reliably written to even a large number of pixels 51 in a large display panel in which load (line time constant) on the scanning line 591 is great and which requires time for the on-voltage to rise and the off-voltage to fall.

[Period i]

The period i is a light emission period.

Figure 3D:
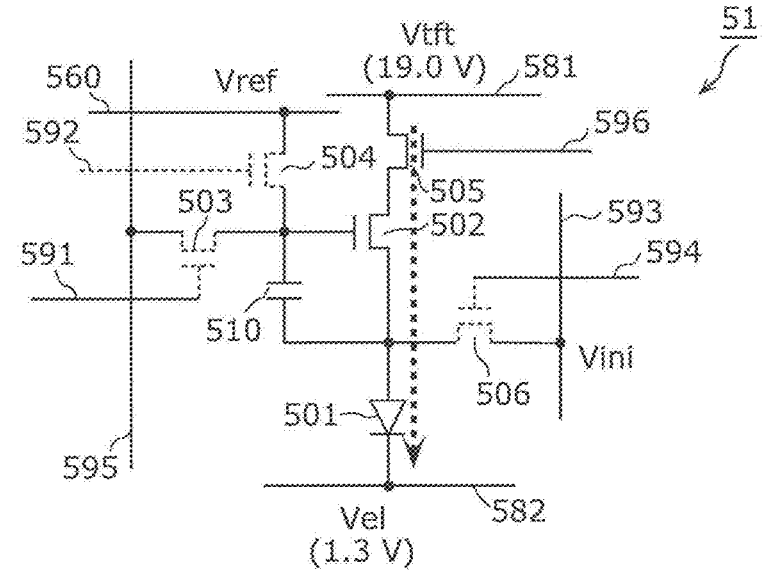
FIG. 3D is a diagram depicting a state of the pixel circuit during a light emission period.

FIG. 3D is a diagram depicting a state of the pixel circuit during the light emission period. Specifically, the voltage level of the emission control line 596 is changed from LOW to HIGH, while keeping the voltage level of the scanning line 591, the voltage level of the reference voltage control line 592, and the voltage level of the initialization control line 594 LOW. To be more specific, the switch 505 is turned on while keeping the switches 503, 504, and 506 off.

In this manner, the switch 505 is turned on, thereby supplying current to the organic EL element 501 and causing the organic EL element 501 to emit light, according to the voltage stored in the capacitor 510.

The above sequence of operations corrects the threshold voltage of the drive transistor 502. Thus, highly accurate emission operation unaffected by variations in characteristics of the drive transistors is achieved.

However, in a conventional display device, it is envisaged that the initialization supply voltage when supplied to the second electrode of the capacitor 510 in the period b and the reference supply voltage when supplied to the first electrode of the capacitor 510 in the period d will fluctuate. If the supply voltages fluctuate, a potential difference between both electrodes of the capacitor 510 is not sufficiently ensured at the start of the detection of threshold voltage. As a result, a threshold voltage may not be detected accurately. In addition, since the detection of threshold voltage is carried out on a per row basis, if the supply voltage fluctuates in a certain period of time, similar error occurs in threshold voltage detection on adjacent rows. This ends up causing display unevenness in a form of horizontal stripes on the display panel.

In contrast, the organic EL display device 1 according to the present disclosure solves the display unevenness in a form of horizontal stripes caused by fluctuations in the reference supply voltage and fluctuations in the initialization supply voltage particularly when detecting the threshold voltage as described above. Specifically, the display unevenness is solved by disposing buffer amplifier circuits, which carry the supply voltages, on driver boards (source driver boards and gate driver boards) described below.

In the following, configuration of the driver boards, which are essential features of the organic EL display device 1 according to the present disclosure, is mainly described.

[Configuration of Driver Boards]

In the following, configuration of driver boards included in the data drive unit 30 and driver boards included in the gate drive unit 40 are described.

Figure 4:
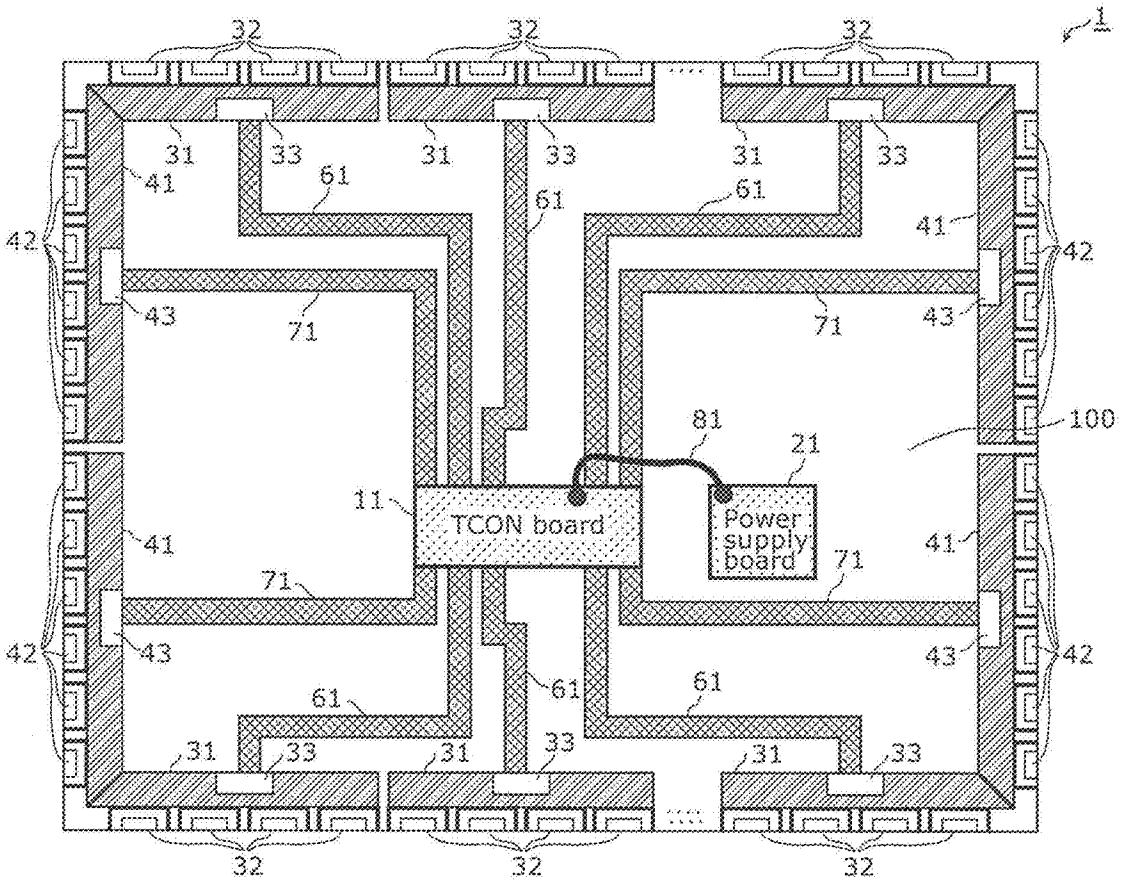
FIG. 4 is a schematic diagram of a display panel back surface of the organic EL display device according to the embodiment.

FIG. 4 is a schematic diagram of a display panel back surface of the organic EL display device according to the embodiment. In the organic EL display device 1, the display unit 50 is disposed on the display surface (not shown in FIG. 4) which is the front surface of a glass substrate 100. As illustrated in FIG. 4, a TCON board 11, a power supply board 21, the source driver boards 31, the gate driver boards 41, the COFs 32 and 42, buffer amplifier circuits 33 and 43, flexible flat cables (FFC) 61 and 71, and a relay harness 81 are disposed on a non-display surface which is the back surface of the glass substrate 100.

On the display surface of the glass substrate 100, the pixels 51 are formed and arranged in rows and columns, the data line 595 and the initialization supply line 593 are disposed for each column of the pixels, and the scanning line 591, the reference voltage control line 592, and the emission control line 596 are disposed for each row of the pixels.

The TCON board 11 corresponds to the control unit 10 in FIG. 1, and the power supply board 21 corresponds to the power supply unit 20 in FIG. 1. The power supply board 21 and the TCON board 11 are connected by the low-impedance relay harness 81, and supply voltage is conveyed from the power supply board 21 to the TCON board 11 via the relay harness 81. The TCON board 11 is also connected to the source driver boards 31 by the FFCs 61 and a voltage corresponding to the supply voltage is carried from the TCON board 11 to the source driver boards 31 via the FFCs 61. Moreover, the TCON board 11 and the gate driver boards 41 are connected by the FFCs 71 and a voltage corresponding to the supply voltage is carried from the TCON board 11 to the gate driver boards 41 via the FFCs 71.

The source driver boards 31, the COFs 32, and the buffer amplifier circuits 33 constitute the data drive unit 30. The COFs 32 are connected to the source driver boards 31 disposed on the non-display surface, and to the data lines 595 and the initialization supply lines 593 formed on the display surface. The COFs 32 are disposed over the display surface and the non-display surface, covering opposing side surfaces of the glass substrate 100.

For example, one buffer amplifier circuit 33 is mounted on one source driver board 31 and connected to the TCON board 11 via the FFC 61. The buffer amplifier circuit 33 outputs the initialization supply voltage to the COFs 32 connected to the source driver board 31. Here, the buffer amplifier circuit 33 outputs the initialization supply voltage that is unaffected by line resistance of the relay harness 81 connecting the power supply board 21 and the TCON board 11, and line resistance of the FFC 61 connecting the TCON board 11 and the source driver board 31. Stated differently, the buffer amplifier circuit 33 cancels (offsets), at the data drive unit 30, a variable component of the supply voltage due to a voltage carrying path to the source driver board 31. Then, the initialization supply voltage stabilized by the cancellation of the variable component is applied to the second electrodes of the capacitors 510 included in pixels 51 via the COFs 32. In other words, the buffer amplifier circuit 33 suppresses the variable component of the supply voltage carried via the TCON board 11 and supplies the initialization supply voltage, which is a stabilized, fixed voltage, to the pixels 51.

The gate driver boards 41, the COFs 42, and the buffer amplifier circuits 43 constitute the gate drive unit 40. The COFs 42 are connected to the gate driver boards 41 disposed on the non-display surface, and the scanning lines 591, the reference voltage control lines 592, and the emission control lines 596 formed on the display surface. The COFs 42 are disposed over the display surface and the non-display surface, covering opposing side surfaces of the glass substrate 100.

For example, one buffer amplifier circuit 43 is mounted on one gate driver board 41 and connected to the TCON board 11 via the FFC 71. The buffer amplifier circuit 43 outputs the reference supply voltage to the COFs 42 connected to the gate driver board 41. Here, the buffer amplifier circuit 43 outputs the reference supply voltage that is unaffected by line resistance of the relay harness 81 connecting the power supply board 21 and the TCON board 11, and line resistance of the FFC 71 connecting the TCON board 11 and the gate driver board 41. Stated differently, the buffer amplifier circuit 43 cancels (offsets), at the gate drive unit 40, a variable component of the reference supply voltage due to a voltage carrying path to the gate driver board 41. Then, the reference supply voltage stabilized by the cancellation of the variable component is applied to the first electrodes of the capacitors 510 included the pixels 51 via the COFs 42. In other words, the buffer amplifier circuit 43 suppresses the variable component of the supply voltage carried via the TCON board 11 and supplies the reference supply voltage, which is a stabilized, fixed voltage, to the pixels 51.

Mounting the buffer amplifier circuit 33 on the source driver board 31 as the above configuration allows the application, to the pixels 51, of the stabilized initialization supply voltage that is unaffected by the line resistances of the relay harness 81, the FFC 61, etc. Mounting the buffer amplifier circuit 43 on the gate driver board 41 allows the application, to the pixels 51, of the stabilized reference supply voltage unaffected by the line resistances of the relay harness 81, the FFC 71, etc. Thus, suppression of display unevenness on the display panel is achieved.

Preferably, the source driver boards 31 are disposed on the top and bottom edge portions of the display panel back surface. This allows a reduction of a voltage drop of the initialization supply voltage at the pixel 51 due to a resistance component of the initialization supply line 593.

Preferably, the gate driver boards 41 are disposed on the left and right edge portions of the display panel back surface. This allows a reduction of a voltage drop of the reference supply voltage due to a resistance component of the reference supply lines 560 disposed on the display unit 50.

From the standpoint of stabilization of the fixed voltages to be applied to the pixels 51, it is contemplated to dispose a component corresponding to power supply on the driver board adjacent to the display unit 50, for example. The screen of organic EL display devices is becoming greater in size and less in thickness and borders. Thus, preferably, the thickness, particularly, in the vicinity of the display panel is about 5 mm or less. Due to this restriction, it is difficult to dispose the power supply per se in the vicinity of the driver boards that are disposed in the vicinity of the display panel. The organic EL display device 1 according to the present embodiment includes thin buffer amplifier circuits corresponding to power supply, which are disposed on the driver boards, in order to achieve both the stabilization of the fixed voltage to be applied to the pixels 51, a thin display panel that has a narrow frame.

While the present embodiment is described with reference to the source driver boards 31 distributed on two opposing edge portions of the display panel and the gate driver boards 41 distributed on the other two opposing edge portions, it should be noted that both or either one of the source driver boards 31 and the gate driver boards 41 may be disposed on one side of the display panel.

[Configuration of Buffer Amplifier Circuit]

In the following, configuration of the buffer amplifier circuit mounted on the driver board is described.

Figure 5A:
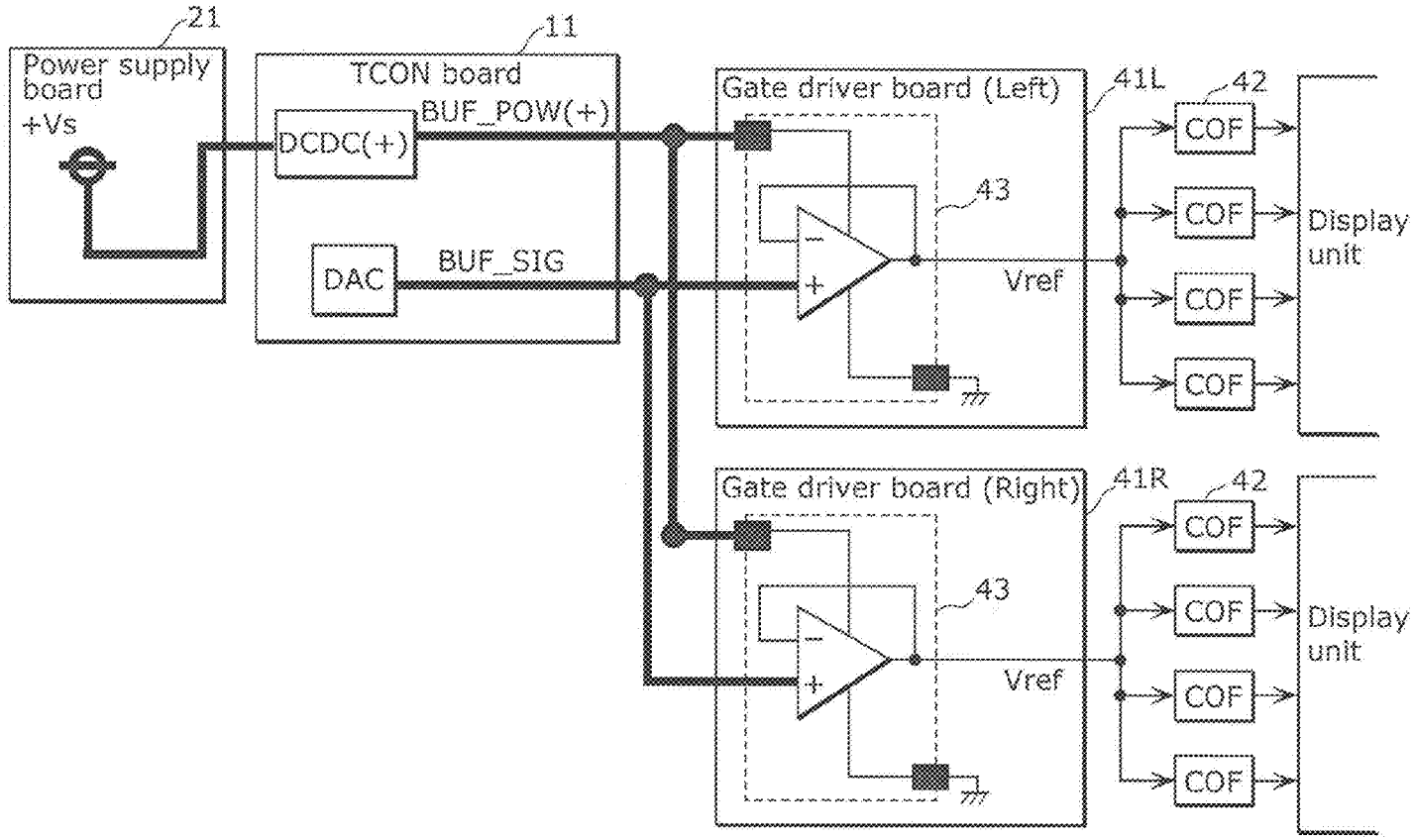
FIG. 5A is a diagram illustrating configuration of buffer amplifier circuits on gate driver boards according to the embodiment.

FIG. 5A is a diagram illustrating configuration of the buffer amplifier circuits on the gate driver boards according to the embodiment. The figure depicts a gate driver board 41L disposed on the left edge portion of the display panel back surface, a gate driver board 41R disposed on the right edge portion of the display panel back surface, the TCON board 11 which supplies the gate driver boards 41L and 41R with voltage corresponding to the supply voltage, and the power supply board 21 which supplies the TCON board 11 with the supply voltage.

The gate driver boards 41L and 41R each include the buffer amplifier circuit 43. The buffer amplifier circuit 43 includes an amplifying element which is a first amplifying element. The supply voltage output from the power supply board 21 is input to a DC-to-DC converter included in the TCON board 11. The first supply voltage (BUF_POW (+)) output from the DC-to-DC converter included in the TCON board 11 is input to the positive power supply terminal of the first amplifying element. A predetermined positive reference voltage (BUF_SIG) output from a digital-to-analog converter (DAC) included in the TCON board 11 is input to the positive input terminal of the first amplifying element. The negative input terminal and an output terminal of the first amplifying element are shorted. The first amplifying element is, for example, an operational amplifier. Owing to the configuration in which the buffer amplifier circuit 43 having a low profile is disposed on the gate driver board 41 in this manner, even if the supply voltage and the first supply voltage fluctuate before reaching the input terminals of the gate driver boards 41L and 41R, the reference supply voltage Vref having a reduced fluctuation is supplied to the COFs 42 without increasing the thickness of the display panel.

Figure 5B:
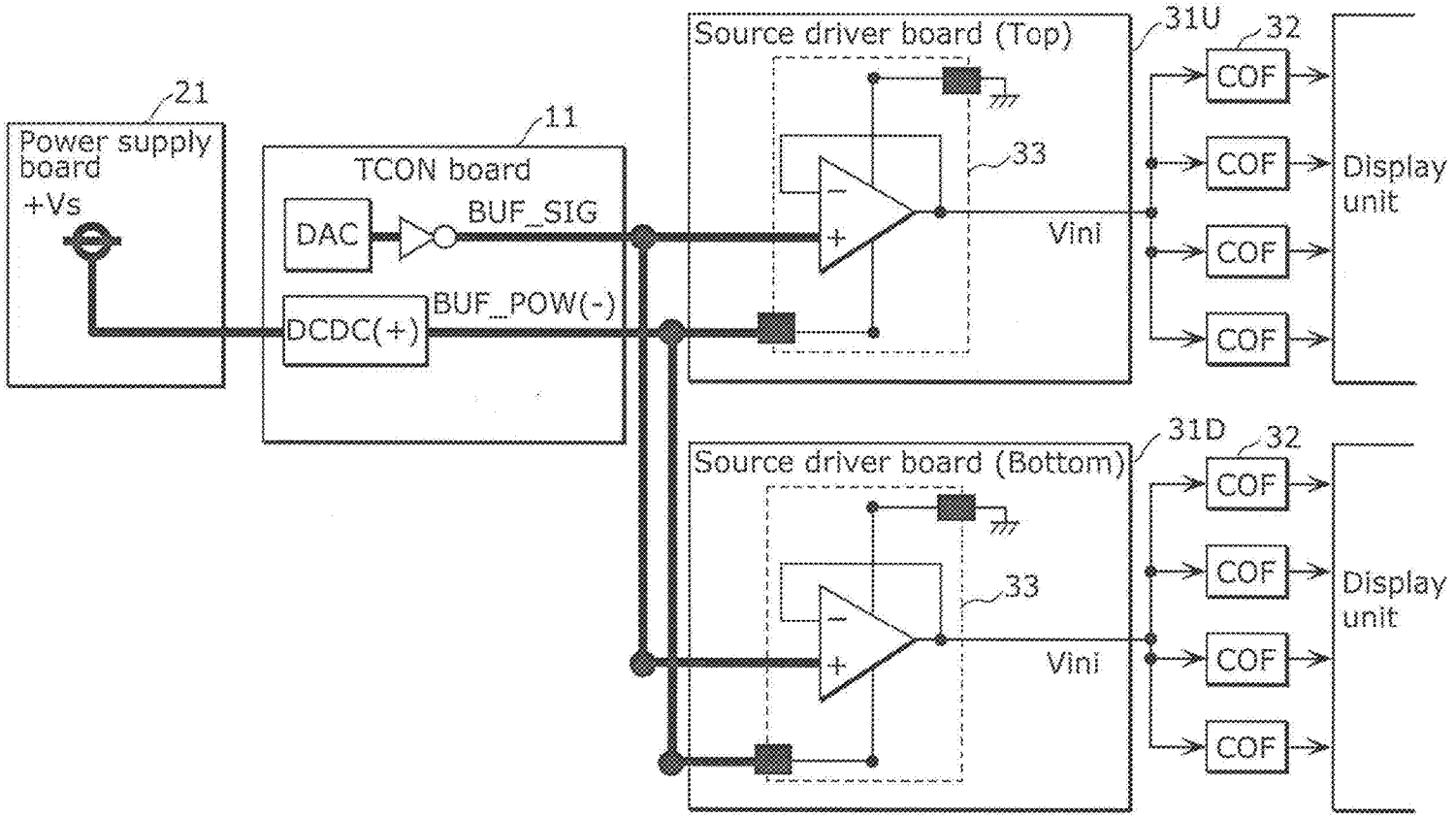
FIG. 5B is a diagram illustrating configuration of buffer amplifier circuits on source driver boards according to the embodiment.

FIG. 5B is a diagram illustrating configuration of the buffer amplifier circuits on the source driver boards according to the embodiment. The figure depicts the source driver board 31U disposed on the top edge portion of the display panel back surface, the source driver board 31D disposed on the bottom edge portion of the display panel back surface, the TCON board 11 which supplies the source driver boards 31U and 31D with voltage corresponding to the supply voltage, and the power supply board 21 which supplies the TCON board 11 with the supply voltage.

The source driver boards 31U and 31D each include the buffer amplifier circuit 33. The supply voltage output from the power supply board 21 is input to the DC-to-DC converter included in the TCON board 11. The buffer amplifier circuit 33 includes an amplifying element which is a second amplifying element. The second supply voltage (BUF_POW (−)) output from the DC-to-DC converter included in the TCON board 11 is input to the negative power supply terminal of the second amplifying element. A predetermined negative reference voltage (BUF_SIG) output from the digital-to-analog converter (DAC) included in the TCON board 11 is input to the positive input terminal of the second amplifying element. The negative input terminal and an output terminal of the second amplifying element are shorted. The second amplifying element is, for example, an operational amplifier. Owing to the configuration in which the buffer amplifier circuit 33 having a low profile is disposed on the source driver board 31 in this manner, even if the supply voltage and the second supply voltage fluctuate before reaching the input terminals of the source driver boards 31U and 31D, the initialization supply voltage having a reduced fluctuation is supplied to the COFs 32, without increasing the thickness of the display panel.

While the present embodiment has been described with reference to the amplifying elements, included in the buffer amplifier circuits 33 and 43, being operational amplifiers, the present disclosure is not limited thereto. The amplifying elements may be supply-voltage stabilization circuits, for example, regulators, insofar as they can enhance capabilities of supplying the input supply voltage.

[Comparison of Supply Voltages]

In the following, the organic EL display device 1 according to the present disclosure having the above configuration is compared to a conventional display device with respect to constancy of supply voltage.

Figure 6A:
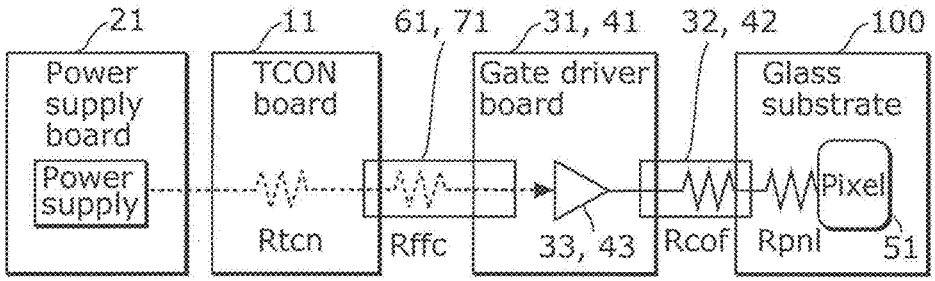
FIG. 6A is a diagram illustrating a suppressing factor of supply voltage fluctuations in the organic EL display device according to the embodiment.
Figure 6B:
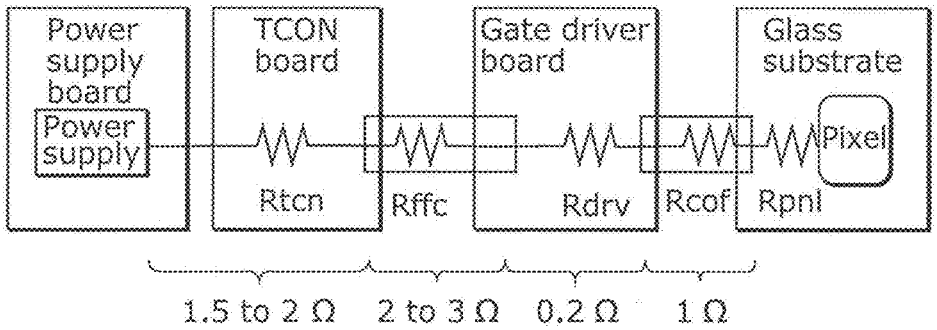
FIG. 6B is a diagram illustrating a factor of fluctuations in supply voltage in a conventional display device.

FIG. 6A is a diagram illustrating a suppressing factor of the fluctuations in supply voltage in the organic EL display device according to the embodiment. FIG. 6B is a diagram illustrating a factor of fluctuations in supply voltage in a conventional display device. FIGS. 6A and 6B illustrate configurations of resistance of the lines formed extending from the power supply boards 21 to the pixels 51 on the glass substrate 100. In both cases, line resistance Rtcn (1.5Ω to 2Ω) in the TCON board 11, resistance Rffc (2Ω to 3Ω) of the FFC, resistance Rcof (1Ω) of the COF, and line resistance Rpnl of the supply lines disposed in the display unit 50 are serially connected. In addition to this, FIG. 6B further illustrates resistance Rdrv (0.2Ω) in the driver board between Rffc and Rcof.

Comparing the configuration of the line resistance, in the organic EL display device 1 according to the present embodiment illustrated in FIG. 6A, owing to the buffer amplifier circuit 33 disposed on the source driver board 31, and the buffer amplifier circuit 43 disposed on the gate driver board 41, a voltage drop due to the line resistance before reaching the driver board need not be taken into consideration. Thus, the organic EL display device 1 according to the present embodiment illustrated in FIG. 6A need only consider the line resistances Rcof and Rpnl between the output end of the driver board and the pixel 51. On the other hand, the conventional display device illustrated in FIG. 6B need consider the line resistances Rtcn and Rffc before the driver board, in addition to the line resistances Rcof and Rpnl.

Figure 7:
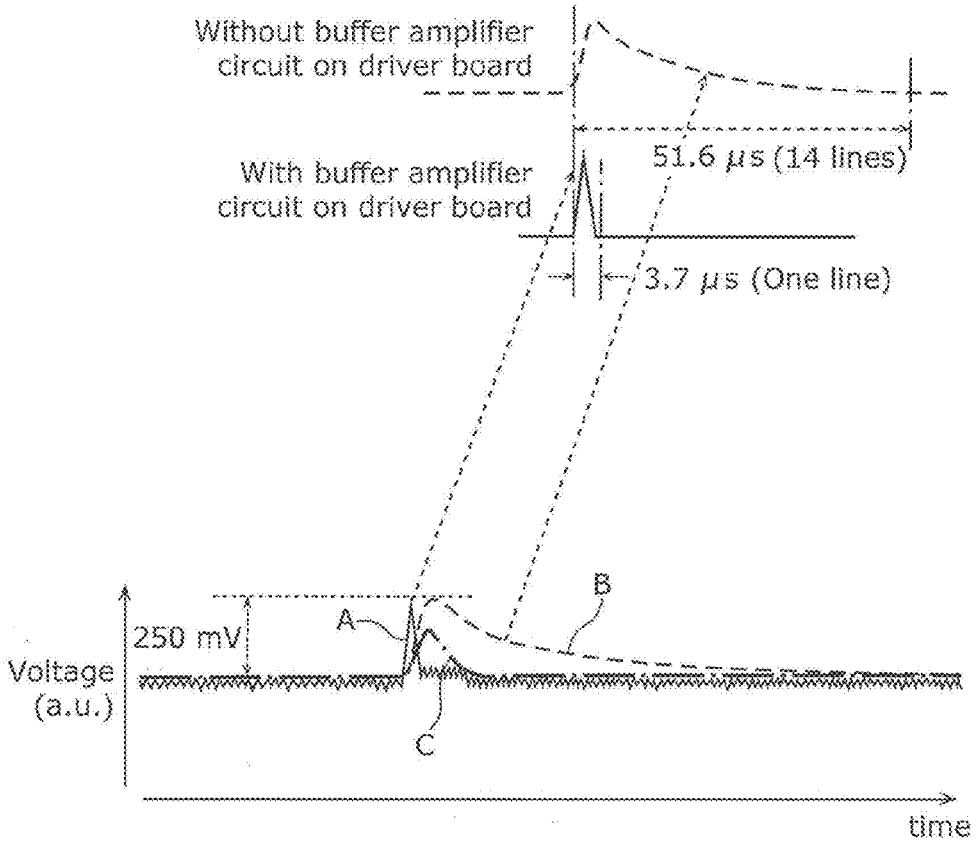
FIG. 7 is a diagram comparing effects of suppression of the fluctuations in reference supply voltage in the organic EL display devices.

FIG. 7 is a diagram comparing effects of suppression of the reference supply voltage fluctuations in the organic EL display devices. The figure depicts fluctuation characteristics (A in FIG. 7) of the reference supply voltage Vref in the pixel 51 included in the organic EL display device 1 according to the embodiment and fluctuation characteristics (B and C in FIG. 7) of the reference supply voltage Vref in a pixel included in the conventional display device.

Specifically, when a predetermined supply voltage fluctuates in the vicinity of the power supply board 21 or the TCON board 11, the reference supply voltage Vref in the pixel fluctuates for 51.6 microseconds in the conventional display device (B in FIG. 7). The fluctuation time period in terms of a scan row corresponds to fourteen scan rows. In other words, due to the fluctuations in the reference supply voltage Vref for 51.6 microseconds, the accuracy in detecting threshold voltage deteriorates across fourteen scan rows, causing display unevenness in a form of horizontal stripes across up to fourteen rows of pixels.

In contrast, in the organic EL display device 1 according to the embodiment, the reference supply voltage Vref fluctuates for 3.7 microseconds (A in FIG. 7). The fluctuation time period in terms of a scan row corresponds to one scan row. In other words, due to the fluctuations in the reference supply voltage Vref for 3.7 microseconds, the accuracy in detecting threshold voltage deteriorates through one row of pixels. Even if this causes display error for one row of pixels, the display error may not be visually recognizable to a viewer.

It should be noted that FIG. 7 indicates that a maximum fluctuating voltage can be reduced in the conventional display device by reducing 2Ω to 3Ω of the line resistance Rffc of the FFC to 0.1Ω (C in FIG. 7). It can be understood from this that the resistance of the lines carrying the supply voltages has a great impact on the fluctuation in supply voltage in a pixel when no buffer amplifier circuit is disposed on the drive board. According to the organic EL display device 1 of the present embodiment, for example, even if the screen size is increased, display unevenness due to the fluctuation in the supply voltage is suppressed, without being affected by a layout of the lines carrying the supply voltages.

[Other Embodiments]

While the organic EL display device according to the embodiment has been described above, the organic EL display device according to the present disclosure is not limited to the above embodiment. Variations obtained by various modifications to the above embodiment that may be conceived by a person skilled in the art without departing from the spirit of the present disclosure, and various devices which include the organic EL display device 1 according to the present disclosure are included in the scope of the organic electroluminescent display device according to the present disclosure.

Moreover, while the above embodiment has been described with reference to an example of the circuit configuration of the pixel circuits included in the organic EL display device according to the present disclosure, the circuit configuration of the pixel 51 is not limited to the circuit configuration described above. For example, while the above embodiment has been described with reference to the switch 505, the drive transistor 502, and the organic EL element 501 arranged in the listed order from the EL anode supply line 581 to the EL cathode supply line 582, the order of arrangement of these three elements may be different. In other words, regardless of whether the drive transistors are of n type or p type, the organic EL display device according to the present disclosure may include the drain electrode and source electrode of the drive transistor 502 and the anode electrode and cathode electrode of the organic EL element 501 disposed lying on the current path between the EL anode supply line 581 and the EL cathode supply line 582, and the order of arrangement of the drive transistor 502 and the organic EL element 501 is not limited.

Moreover, while the above embodiment has been described assuming that the switches 503 to 506 are MOSFETs each including a gate electrode, a source electrode, and a drain electrode, these transistors may be bipolar transistors each including a base, collector, and emitter. In this case also, the object of the present disclosure is achieved and the advantageous effects of the present disclosure are provided.

The control unit (control circuit) included in the organic EL display device 1 according to the above embodiment is typically implemented in an LSI which is an integrated circuit. It should be noted that part of the control circuit included in the organic EL display device may be integrated on the substrate on which the display unit 50 is disposed. Alternatively, the control circuit may be implemented in a dedicated circuit or a general-purpose processor. Alternatively, a field programmable gate array (FPGA) that is programmable after manufacturing the LSI or a reconfigurable processor that allows re-configuration of the connection or configuration of the LSI can be used Moreover, some of the functionalities of the gate drive unit, the data drive unit, and the control unit included in the organic EL display device 1 according to the above embodiment may be implemented by a processor such as a CPU executing programs.

Moreover, the organic EL display device 1 according to the above embodiment has been described with reference to the display device that utilizes organic EL elements, the present disclosure is also applicable to display devices that utilize light-emitting elements other than organic EL elements.

Figure 8:
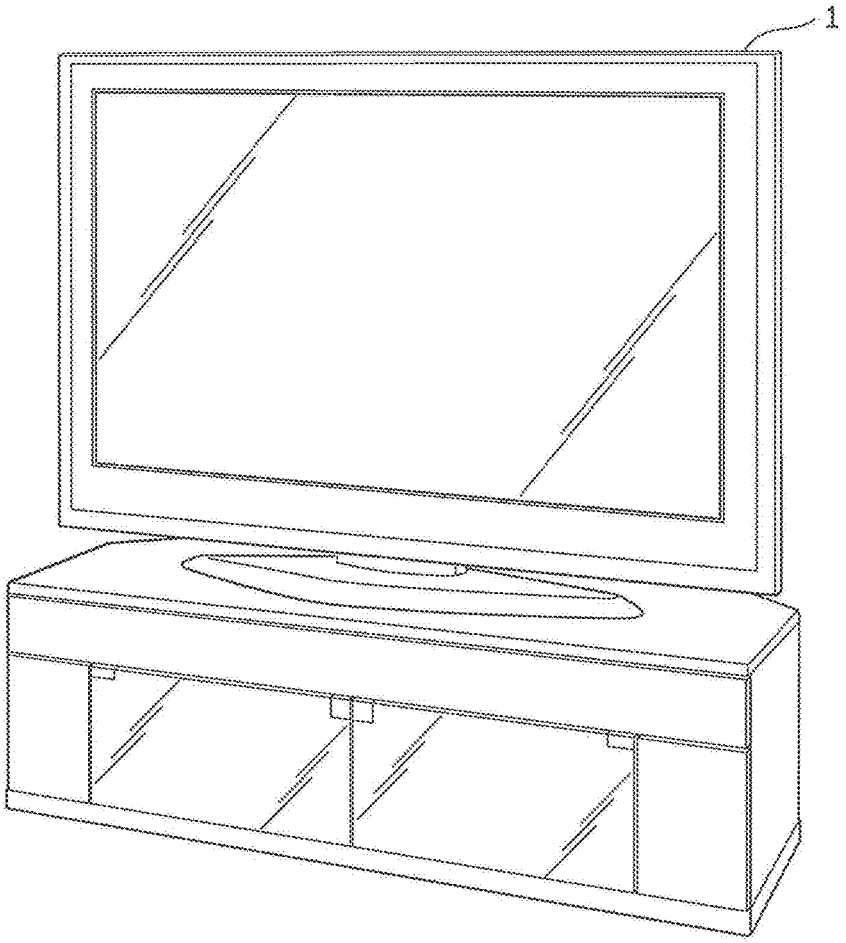
FIG. 8 is an external view of a thin, flat TV which includes the organic EL display device according to the embodiment.

Moreover, for example, the organic EL display device 1 according to the above embodiment is built in a thin, flat television as illustrated in FIG. 8 by incorporating the organic EL display device 1 according to the above embodiment. A thin, flat television that allows high-precision image display having suppressed display unevenness is achieved.

[Industrial Applicability]

The present disclosure is useful particularly for an active matrix organic electroluminescent flat panel display.

The invention claimed is:

1. An organic electroluminescent display device, comprising:

a display in which pixels are arranged in rows and columns, the pixels each including an organic electroluminescent element; a drive transistor which drives light emission of the organic electroluminescent element; and a capacitor having a first electrode to which a gate potential of the drive transistor is applied and a second electrode to which a potential of one of a drain and a source of the drive transistor is applied;

a power supply configured to generate a supply voltage;

a signal driver disposed on an electrical path between the power supply and the display, the signal driver configured to apply a fixed voltage corresponding to the supply voltage to at least one of the first electrode and the second electrode, and output a data signal corresponding to a video signal and a select signal which selects a pixel to be supplied with the data signal among the pixels; and a timing controller disposed on an electrical path between the power supply and the signal driver, the timing controller configured to carry to the signal driver the supply voltage output from the power supply, and indicate to the signal driver a time at which the signal driver is to output the data signal and the select signal, wherein the signal driver includes a buffer amplifier circuit which suppresses a variable component of the supply voltage carried from the power supply to stabilize the fixed voltage corresponding to the supply voltage, and supplies the stabilized, fixed voltage to the at least one of the first electrode and the second electrode, the signal driver includes a gate driver having a plurality of gate driver integrated circuits and a gate driver board connecting the plurality of gate driver integrated circuits and the timing controller, and a first buffer amplifier circuit is mounted on the gate driver board.

2. The organic electroluminescent display device according to claim 1, wherein the fixed voltage is at least one of a reference supply voltage and an initialization supply voltage, the reference supply voltage being applied to the first electrode to cause the capacitor to hold a threshold voltage of the drive transistor, the initialization supply voltage being applied to the second electrode.

3. The organic electroluminescent display device according to claim 2, wherein the signal driver includes a gate driver configured to output the select signal, a data driver is configured to output the data signal, the data driver includes a plurality of source driver integrated circuits and a source driver board connecting the plurality of source driver integrated circuits and the timing controller, the display is disposed on a front surface of a display panel, the power supply, the timing controller, a line electrically connecting the timing controller and the signal driver, and the buffer amplifier circuit are disposed on a back surface of the display panel, the first buffer amplifier circuit outputs to the plurality of gate driver integrated circuits the reference supply voltage stabilized by suppressing the variable component of the supply voltage, and a second buffer amplifier circuit, which outputs to the plurality of source driver integrated circuits the initialization supply voltage stabilized by suppressing the variable component of the supply voltage, is mounted on the source driver board.

4. The organic electroluminescent display device according to claim 3, wherein the gate driver includes:

a first gate driver board disposed on a left edge portion of the display panel and connecting the timing controller and gate driver integrated circuits among the plurality of gate driver integrated circuits; and a second gate driver board disposed on a right edge portion of the display panel and connecting the timing controller and gate driver integrated circuits among the plurality of gate driver integrated circuits.

5. The organic electroluminescent display device according to claim 3, wherein the data driver includes:

a first source driver board disposed on a top edge portion of the display panel and connecting the timing controller and source driver integrated circuits among the plurality of source driver integrated circuits; and a second source driver board disposed on a bottom edge portion of the display panel and connecting the timing controller and source driver integrated circuits among the plurality of source driver integrated circuits.

6. The organic electroluminescent display device according to claim 3, wherein while causing the gate driver to select a pixel row-by-row, the timing controller is configured to cause the capacitor to hold the threshold voltage of the drive transistor row-by-row by causing the gate driver to apply the reference supply voltage to the first electrode of the capacitor and causing the data driver to apply the initialization supply voltage to the second electrode of the capacitor.

7. The organic electroluminescent display device according to claim 3, wherein the first buffer amplifier circuit includes a first amplifying element having a positive power supply terminal to which the supply voltage carried via the timing controller is input, a positive input terminal to which a predetermined positive voltage generated by the timing controller is input, and a negative input terminal and an output terminal which are shorted, and the second buffer amplifier circuit includes a second amplifying element having a negative power supply terminal to which the supply voltage carried via the timing controller is input, a positive input terminal to which a predetermined negative voltage generated by the timing controller is input, and a negative input terminal and an output terminal which are shorted.

* * * * *